US006411159B1

(12) United States Patent
Callahan, Jr.

(10) Patent No.: US 6,411,159 B1
(45) Date of Patent: Jun. 25, 2002

(54) CIRCUIT FOR CONTROLLING CURRENT LEVELS IN DIFFERENTIAL LOGIC CIRCUITRY

(75) Inventor: Michael J. Callahan, Jr., Austin, TX (US)

(73) Assignee: STMicroelectronics, Inc., Carrollton, TX (US)

( * ) Notice: Subject to any disclaimer, the term of this patent is extended or adjusted under 35 U.S.C. 154(b) by 0 days.

(21) Appl. No.: 09/620,786

(22) Filed: Jul. 21, 2000

(51) Int. Cl.[7] ..... G06G 7/26
(52) U.S. Cl. ..... 327/563; 327/538; 327/543
(58) Field of Search ..... 327/52, 66, 53, 327/65, 287, 543, 588, 519, 563; 330/257, 261; 326/126

(56) References Cited

U.S. PATENT DOCUMENTS

| | | | | |
|---|---|---|---|---|
| 5,153,529 A | * | 10/1992 | Koda et al. | 330/295 |
| 5,451,898 A | * | 9/1995 | Johnson | 327/563 |
| 5,455,539 A | * | 10/1995 | Mazoyer et al. | 330/258 |
| 5,642,062 A | * | 6/1997 | Kawakami | 327/66 |
| 5,734,272 A | | 3/1998 | Belot et al. | 326/126 |
| 6,160,441 A | * | 12/2000 | Stratakos et al. | 327/540 |

OTHER PUBLICATIONS

A PLL CLock Generator with 5 to 110 MHz of Lock Range for Microprocessors, by Ian A. Young, Jeffrey K. Greason, and Keng L. Wong, IEEE Journal of Solid–State Circuits, vol. 27, No. 11, Nov. 1992, pp. 1599–1607.

* cited by examiner

*Primary Examiner*—Tuan T. Lam
*Assistant Examiner*—Hiep Nguyen
(74) *Attorney, Agent, or Firm*—Lisa K. Jorgenson; Andre Szuwalski

(57) ABSTRACT

A method and circuit are disclosed for controlling the current level of a differential logic circuit having a current source, input transistors which perform current steering based upon the input to the differential logic circuit, and load transistors. The circuit includes a first transistor that forms a current mirror with the current source, a second transistor coupled to the load transistors so that the operating characteristics of the load transistors substantially match the operating characteristics of the second transistor, and current source circuitry coupled between the first and second transistors. The current level selected in the current source circuitry sets the current level in the differential logic circuit and the resistance of the load transistors so that the output voltage swing of the differential logic circuit stays within an acceptable range of voltages, regardless of the selected current level.

39 Claims, 2 Drawing Sheets

CIRCUIT FOR CONTROLLING CURRENT LEVELS IN DIFFERENTIAL LOGIC CIRCUITRY

BACKGROUND OF THE INVENTION

1. Technical Field of the Invention

The present invention relates to controlling current levels in differential logic circuits, such as emitter-coupled logic (ECL) circuits and source-coupled logic (SCL) circuits, and particularly to setting the current levels in differential logic circuits without changing the output voltage swing thereof.

2. Background of the Invention

Emitter coupled logic (ECL) circuits are among the fastest types of integrated circuits. To obtain a high operating speed, ECL circuits are designed so that the bipolar transistors therein never saturate. The signals processed by ECL circuits are mostly differential signals, and each component of the differential signal is applied to a separate input of the differential circuit.

FIG. 1 represents a conventional ECL inverter circuit. The collector terminals of bipolar transistors Ta and Tb are connected to a positive supply Vdd through respective load resistors R and a bias current source I is connected between the emitter terminals of bipolar transistors Ta and Tb and negative supply Vss. The base terminals of transistors Ta and Tb receive the differential input signal A—A*. The differential output V is taken as a voltage between the collector terminals of transistors Ta and Tb.

ECL signals have a small voltage swing. In other words, the voltage difference between the high state and the low state of a component of an ECL signal is relatively small. This small voltage swing, which is approximately 0.5 volt, improves the speed of the ECL circuit by reducing and/or eliminating the time otherwise spent charging and discharging capacitances commonly found in ECL circuits.

The speed of the ECL and other differential logic circuits is mainly limited by the capacitances of the bipolar transistors therein. The collector terminal of a bipolar transistor has a time response inversely proportional to the collector current. Therefore, to increase the speed, high currents are typically used. The load resistors in an ECL circuit accordingly possess a relatively low resistive value in order to limit the voltage swing of the ECL signals to the desired value and to present a lower RC time constant relating to the transition time for an ECL signal. Because current continuously flows through a branch of an ECL circuit, a drawback of ECL circuits is the relatively high power consumption thereof.

Some ECL circuits are designed to operate at various frequencies. For example, some Asynchronous Transmission Mode (ATM) circuits operate at speeds of 155 and 622 Megabits per second (an ITU-I-432 standard).

It can be seen that differential logic circuits designed to operate at the highest possible speed operate at relatively high current levels and thus dissipate a relatively high amount of power. However, such high current levels are unnecessary for lower frequency applications.

A conventional approach to limit power consumption at lower speed applications is to adjustably lower the current levels in each ECL circuit. To maintain the same voltage swing, the load resistors in the ECL circuit are replaced with diodes. Thus, a steady voltage swing of approximately 0.7 volt is maintained for a variety of current levels. However, the resulting voltage swing is not compatible with standard ECL technology and varies with temperature. In addition, the presence of diodes increases the capacitances in the ECL circuit.

PCT application WO-A-93/18587 describes an ECL circuit whose power consumption is adjustable as a function of the operating frequency. The power consumption adjustment is effectuated by adjusting the bias current and the resistance of the load devices of the ECL circuit based upon the operating frequency. However, the circuitry for performing the current and resistance adjustments is relatively complex. For example, an adjustment signal would be a digital signal provided by a microprocessor. This digital signal would need to be converted to analog form before it can act on the bias current or on the load devices.

Another approach is described in U.S. Pat. No. 5,734,272 (the '272 Patent), which shows an ECL circuit (FIG. 2) and corresponding control circuit therefor that modifies the current level in the ECL circuit as well as the resistances of the load transistors therein. It is noted, however, that load transistors Rv operate in the linear region of operation while bias transistor Rc (the transistor whose operating characteristics load transistors Rv are to match) operates in the saturated region of operation. The current transfer ratio of the current mirror including transistors Rc and Rv is thus not 1:1. Consequently, in order to maintain a constant voltage swing across load transistors Rv as the current Iv in the differential logic circuit is changed, a separate current source (Ic) must be used to bias load transistors Rv from the current source (Iv) used to bias input transistors Ta and Tb. The resulting current relationship for the differential logic circuit (equation 3; column 4, line 1 of the '272 patent) also shows that the current relationship between currents Ic and Iv (and hence the control of the output voltage swing of the differential logic circuit) is dependent upon transistor dimensions, process parameters and temperature.

Based upon the foregoing, there is a need for the operating characteristics of the load transistors in a differential logic circuit and the bias current therein to substantially closely and easily follow each other, substantially without dependencies upon process parameters, device dimensions and temperature.

SUMMARY OF THE INVENTION

The present invention overcomes the shortcomings in prior differential logic circuits and control circuits therefor, and satisfies a significant need for a logic circuit having selected current levels while maintaining an output voltage swing that remains within a predetermine voltage range. In accordance with an embodiment of the present invention, there is provided a control circuit for a differential logic circuit including a current source and a pair of load transistors. The control circuit includes a pull-down transistor having a first conduction terminal coupled to a first voltage source, a second conduction terminal and a control terminal coupled to the current source of the differential logic circuit so as to form a current mirror therewith; a pull-up transistor having a control terminal coupled to the control terminal of the load transistors, a first conduction terminal coupled to a second voltage source and a second conduction terminal; and a controlled current source coupled between the pull-up transistor and the pull-down transistor. The controlled current source receives an input signal that controls the level of current passing through the differential logic circuit and the resistance of the load transistors, wherein the product of the current passing through the load transistors and the resistance thereof does not substantially vary.

The operation of the control circuit and corresponding differential logic circuit includes selecting a current level passing through the controlled current source, which sets the current level of the current source in the differential logic circuit to the desired level. The selected current level also sets the operating characteristics of the pull-up transistor, which thereupon sets the operating characteristics of the load transistors of the differential logic circuit. The current level of the differential logic circuit and the resistance level of the load transistors are inversely proportional to each other. In this way, a single selected current level of the control circuit sets the current level and thus the speed of the differential logic circuit while maintaining an output voltage swing thereof that does not substantially vary.

BRIEF DESCRIPTION OF THE DRAWINGS

A more complete understanding of the system and method of the present invention may be obtained by reference to the following Detailed Description when taken in conjunction with the accompanying Drawings wherein.

DETAILED DESCRIPTION OF THE PREFERRED EXEMPLARY EMBODIMENTS

The present invention will now be described more fully hereinafter with reference to the accompanying drawings in which a preferred embodiment of the invention is shown. The embodiment is provided so that this disclosure will be thorough and complete, and will fully convey the scope of the invention to those skilled in the art.

Figure 1:
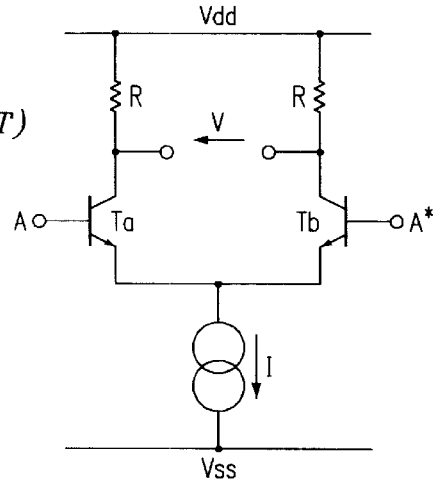
FIG. 1 (PRIOR ART)
FIG. 1 is a schematic diagram of a conventional differential logic circuit.
Figure 2:
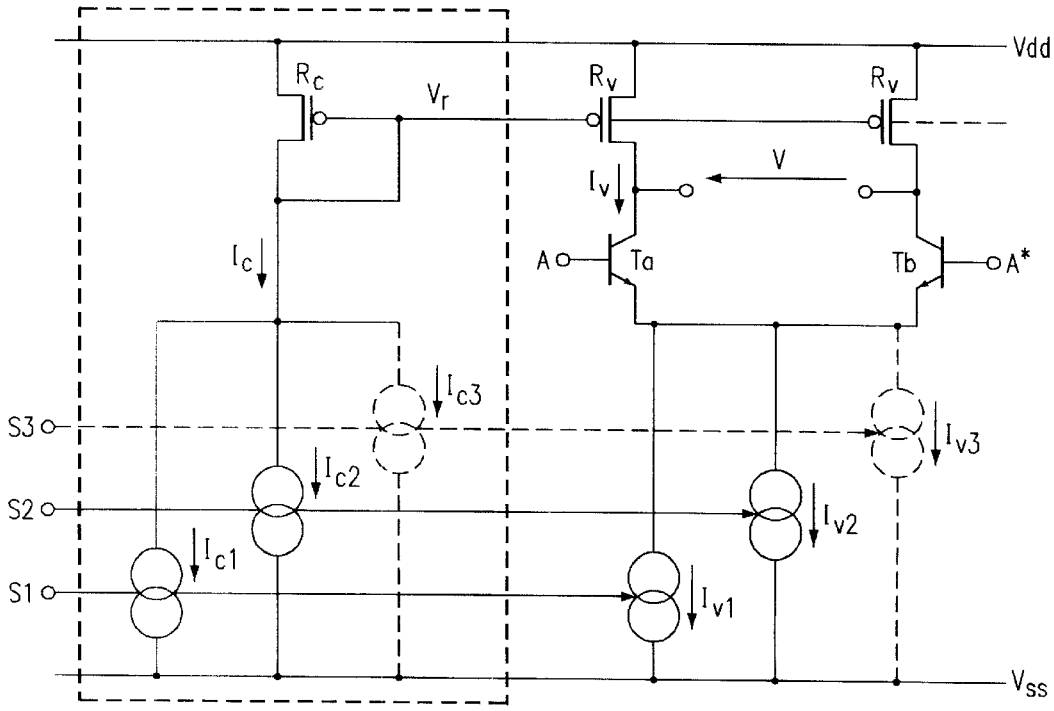
FIG. 2 (PRIOR ART)
FIG. 2 is a schematic diagram of an existing control circuit in conjunction with the conventional differential logic circuit of FIG. 1.
Figure 3:
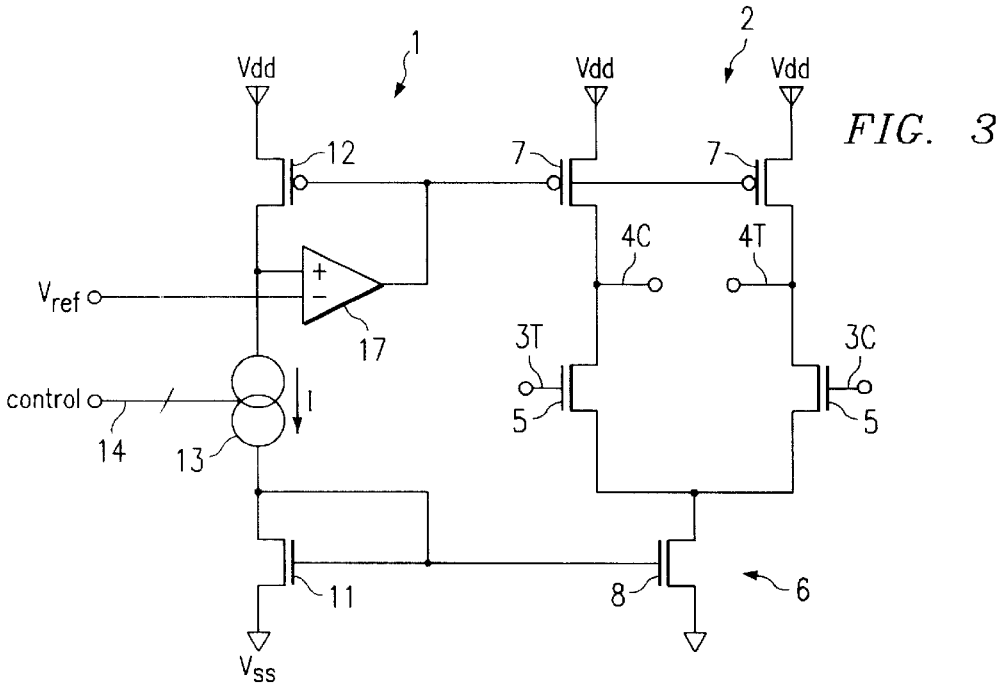
FIG. 3 is a schematic diagram of a control circuit according to an embodiment of the present invention in conjunction with a differential logic circuit.
Figure 4:
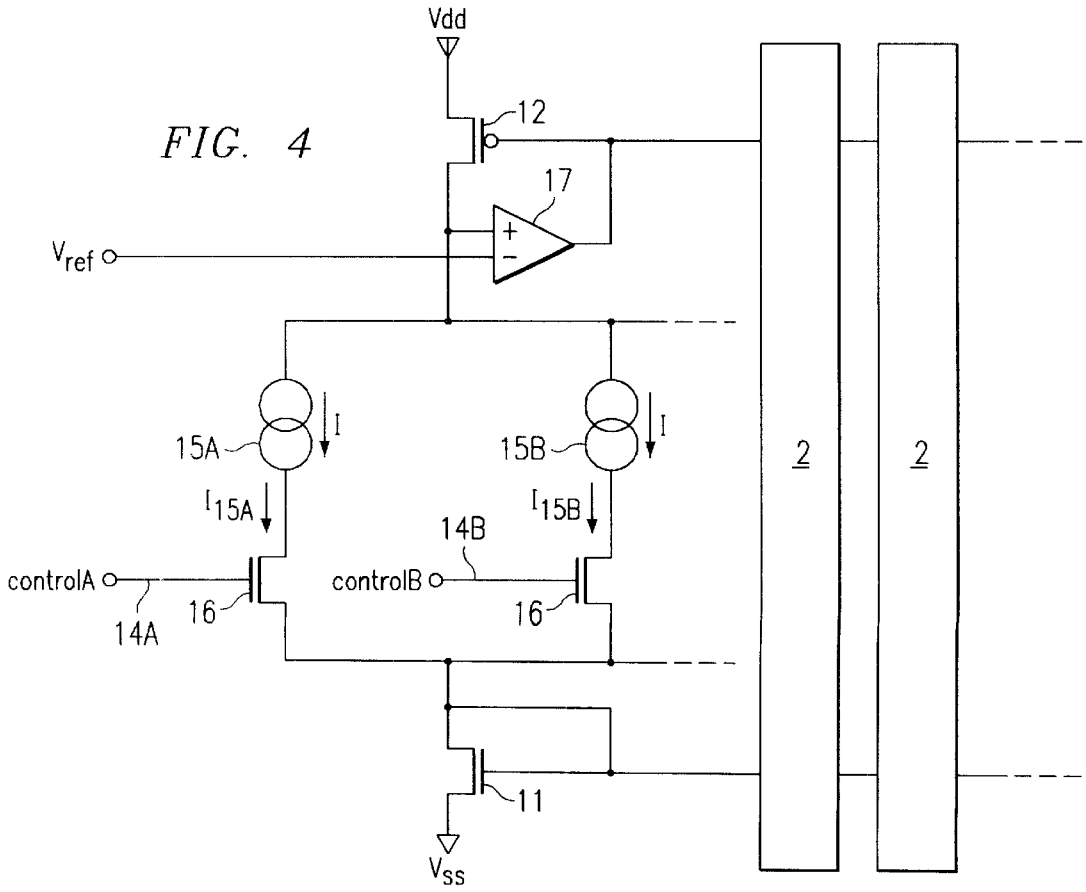
FIG. 4 is a schematic diagram of a current source circuit block shown in FIG. 3.

Referring to FIGS. 3 and 4, there is shown a control circuit 1 for setting the current level of a differential logic circuit 2. Differential logic circuit 2 is adapted to receive at least one pair of differential input signals 3 (3T and 3C) and steer current along one of a plurality of current paths between the positive supply Vdd and negative supply Vss based upon differential input signals 3T and 3C. Differential logic circuit 2 may be a conventional differential logic circuit having at least one pair of input transistors 5 for receiving the differential input signals 3T and 3C, and a pair of differential output signals 4T and 4C. Each input transistor 5 includes a first conduction or source terminal that is coupled to the first conduction or source terminal of the other input transistor 5, a second conduction or drain terminal and a control or gate terminal which receives one of differential input signals 3T and 3C. Input transistors 5 perform current steering based upon input signals 3T and 3C. Input transistors 5 are matched transistors so as to provide substantially symmetrical operation.

Differential logic circuit 2 may further include a current source 6 coupled between the first conduction or source terminals of input transistors 5 and a negative supply Vss. Current source 6 may include a transistor 8 having a first conduction or drain terminal coupled to the first conduction terminals of input transistors 5 and a second conduction or source terminal coupled to the negative supply Vss.

A pair of load transistors 7 are coupled between the input transistors 5 and a positive supply Vdd. A first conduction or drain terminal of a load transistor 7 is coupled to the second conduction or drain terminal of an input transistor 3, and a second conduction or source terminal of a load transistor 7 is coupled to the positive supply Vdd. The control or gate terminals of load transistors 7 are connected together.

Although input transistors 5 and load transistors 7 are illustrated in FIG. 3 as being n-channel and p-channel MOS transistors, respectively, it is understood that input transistors 3 and/or load transistors 7 may be other MOS transistors, such as bipolar transistors or junction field effect transistors (JFETs). It is also understood that differential logic circuit 2 may have a different number of transistors and/or a different transistor configuration so as to perform any of a variety of boolean operations.

Because differential logic circuits, such as differential logic circuit 2, typically dissipate a relatively sizeable amount of current for high speed applications, it is desirable to be able to set the current passing through differential logic circuit 2 to a lower level for lower speed applications without altering the output voltage characteristics of differential logic circuit 2. Control circuit 1 selectively controls the current level in differential logic circuit 2 and the resistance of load transistors 7 therein. Control circuit 1 may include a first and/or pull-down transistor 11 having a first conduction or drain terminal coupled to the control or gate terminal of first transistor 11. A second conduction or source terminal is coupled to the negative supply Vss. The control terminal of first transistor 11 is also coupled to the control terminal of the transistor 8 of current source 6 so that first transistor 11 and current source transistor 8 form a current mirror circuit. Consequently, the current level flowing through current source transistor 8 is proportional to the current flowing through first transistor 11. First transistor 11 may be an n-channel MOS transistor, but it is understood that first transistor 11 may be other transistor types as well.

Control circuit 1 may further include a second and/or pull-up transistor 12 having a first conduction or source terminal coupled to the positive supply Vdd and a second conduction or drain terminal. A control or gate terminal of second transistor 12 is coupled to the control terminal of load transistors 7. Second transistor 12 may be a p-channel MOS transistor and matched to load transistors 7.

A controllable circuit 13 may be disposed between first transistor 11 and second transistor 12 and define a current level therein. Circuit 13 may receive one or more control signals 14, such as digital control signals, which identify a desired current level to flow through differential logic circuit 2. For example, circuit 13 may include a plurality of current sources 15 (FIG. 4), each of which is series coupled to a distinct transmission gate and/or switch 16. The series combinations of current source 15 and switch 16 are parallel connected to each other. The activated one of switches 16 defines a current through control circuit 1 and differential logic circuit 2.

Alternatively, circuit 13 may include a component or components that allow for the selective setting of a current level in first transistor 11 and second transistor 12. For example, circuit 13 may include a MOS transistor having a gate terminal that is controlled by control signal 14, or other circuitry providing a resistance value between first transistor 11 and second transistor 12 that is adjustable by control signal(s) 14.

Similar to load devices in existing differential logic circuits, load transistors 7 are adapted to operate in the linear or triode mode/region of operation so as to provide a resistive value that controllably varies substantially linearly. According to the embodiment of the present invention, second transistor 12 is controlled so as to also operate in the linear or triode mode of operation. In this way, the operating characteristics of load transistors 7 may be closely matched to the operating characteristics of second transistor 12 so that a (linear) change in resistance in second transistor 12 will cause approximately the same (linear) resistance change in load transistors 7. This relationship between second transistor 12 and load transistors 7 allows for a more accurate control of the operating characteristics of load transistors 7 and thus the output voltage swing of differential logic circuit 2.

In order to maintain second transistor 12 in the linear region, control circuit 1 may include a differential amplifier 17 having a first (non-inverting) input coupled to the drain terminal of second transistor 12 and an output coupled to the gate terminal of second transistor 12. A second (inverting) input of differential amplifier 17 may be tied to a reference voltage source Vref. Reference voltage Vref may be between the positive supply Vdd and the negative supply Vss. By way of one example, reference voltage source Vref may be approximately one volt (1v) below positive supply Vdd. This amplifier feedback circuit forces the drain terminal of second transistor 12 to be at approximately one volt (1v) less than the positive supply Vdd so that second transistor 12 is maintained within the linear region. The gate terminal of second transistor 12 is driven to a voltage level that is determined by the difference in voltage between the drain terminal of second transistor 12 and reference voltage Vref, as well as the gain of differential amplifier 17 and the overall effect of the negative feedback. The resulting voltage level appearing on the gate terminal of second transistor 12 is less than the voltage appearing on the drain terminal thereof by at least the threshold voltage value of second transistor 12.

It is understood that reference voltage source Vref may be at another voltage so long as amplifier circuit 17 maintains second transistor 12 within the linear region of operation.

It is understood that control circuit 1 may be utilized to control a plurality of differential logic circuits 2, as shown in FIG. 4.

The operation of control circuit 1 and differential logic circuit 2 will be described. Differential logic circuit 2 may be configured into a high current mode by control signal 14A being asserted to enable current source 15A. Once enabled, a predetermined current level $I_{15A}$ flows through current source 15A, first transistor 11 and second transistor 12. Due to the current mirror formed between first transistor 11 and the transistor 8 in current source 6, a current level proportional to current level $I_{15A}$ flows through current source 6.

Meanwhile, differential amplifier 17 maintains second transistor 17 in the linear region of operation, with the voltage appearing on the drain terminal being approximately reference voltage Vref. As the high current level $I_{15A}$ flows through second transistor 12 so as to initially lower the drain terminal thereof, differential amplifier circuit 17 drives the gate terminal of second transistor 12 to a lower voltage level so as to increase the drain terminal voltage back to approximately the reference voltage Vref. In other words, the resistance of second transistor 12 is decreased as a result of the selection of the high current level $I_{15A}$. The lowered gate voltage appearing at the gate terminal of second transistor 12 also lowers the resistance of load transistors 7. With load transistors 7 having a lowered resistance and a high current level $I_{15A}$ passing therethrough, the output voltage of differential logic circuit 2 (i.e., the product of the current in differential logic circuit 2 and the resistance of load transistors 7) may remain within a predetermined range of voltage levels, such as within ECL voltage levels.

Alternatively, differential logic circuit 2 may be configured into a low current mode by control signal 14B being asserted to enable current source 15B. Once enabled, a predetermined current level $I_{15B}$ flows through current source 15B, first transistor 11 and second transistor 12. Due to the current mirror formed between first transistor 11 and the transistor 8 in current source 6, a current level proportional to current level $I_{15B}$ flows through current source 6.

Meanwhile, differential amplifier 17 maintains second transistor 17 in the linear region of operation, with the voltage appearing on the drain terminal being approximately reference voltage Vref. As the lowered current level $I_{15B}$ flows through second transistor 12 so as to initially raise the drain terminal thereof, differential amplifier circuit 17 drives the gate terminal of second transistor 12 to a higher voltage level so as to decrease the drain terminal voltage back to approximately the reference voltage Vref. In other words, the resistance of second transistor 12 is increased as a result of the selection of the lower current level $I_{15B}$. The raised gate voltage appearing at the gate terminal of second transistor 12 also increases the resistance of load transistors 7. With load transistors 7 having an increased resistance and a lowered current level $I_{15B}$ passing therethrough, the output voltage of differential logic circuit 2 may remain within a predetermined range of voltage levels, such as within ECL voltage levels.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A control circuit for a differential logic circuit including a current source and a pair of load transistors, each load transistor including a control terminal, the control circuit comprising:

a first transistor having a first conduction terminal coupled to a first voltage source and coupled to the current source of the differential logic circuit so as to form a current mirror therewith;

a second transistor having a control terminal coupled to the control terminal of the load transistors and a first conduction terminal coupled to a second voltage source, the second transistor operating in a linear region of operation; and a controllable current source coupled between the second transistor and the first transistor, the controllable current source receiving an input signal generated externally to the control circuit, and controlling the level of current passing through the current source of the differential logic circuit and a resistance of the load transistors based upon the value of the input signal, the product of the current passing through the load transistors and the resistance value of the load transistors being substantially constant.

2. The control circuit of claim 1, further comprising:

a device coupled between a second conduction terminal of the second transistor and the control terminal thereof, for maintaining the second transistor in the linear region of operation.

3. A control circuit for a differential logic circuit including a current source and a pair of load transistors, each load transistor including a control terminal, the control circuit comprising:

a first transistor having a first conduction terminal coupled to a first voltage source and coupled to the current source of the differential logic circuit so as to form a current mirror therewith;

a second transistor having a control terminal coupled to the control terminal of the load transistors and a first conduction terminal coupled to a second voltage source, the second transistor operating in a linear region of operation;

a controllable current source coupled between the second transistor and the first transistor, the controllable current source receiving an input signal and controlling the level of current passing through the current source of the differential logic circuit and the load transistors based upon the input signal, the product of the current passing through the load transistors and the resistance value of the load transistors being substantially constant; and a device comprising a differential amplifier circuit having a first input terminal coupled to the second conduction terminal of the second transistor and an output terminal coupled to the control terminal thereof, for maintaining the second transistor in the linear region of operation.

4. The control circuit of claim 3, wherein:

the differential amplifier includes a second input terminal connected to a third voltage source.

5. The control circuit of claim 4, wherein:

a voltage level associated with the third voltage source is between the voltages associated with the first and second voltage sources.

6. The control circuit of claim 1, wherein:

the output voltage swing of the differential logic circuit is substantially independent of process parameters.

7. The control circuit of claim 1, wherein:

the output voltage swing of the differential logic circuit is substantially temperature independent.

8. The control circuit of claim 1, wherein:

the second transistor and the first transistor comprise MOS transistors.

9. The control circuit of claim 1, wherein:

the operating characteristics of the load transistors substantially match the operating characteristics of the second transistor.

10. A digital circuit, comprising:

at least one differential logic circuit, comprising:

a pair of input transistors, each input transistor having first and second conduction terminals and a control terminal, the first conduction terminals of the input transistors being connected together;

a current source coupled between the first conduction terminals of the input transistors and a first reference voltage source; and a pair of load transistors, each load transistor having a first conduction terminal coupled to the second terminal of an input transistor, a second conduction terminal coupled to a second reference voltage source and a control terminal coupled to a control terminal of the other load transistor, the output of the differential logic circuit being the voltage difference across the first conduction terminals of the load transistors; and a control circuit for selectively controlling a level of current passing through the current source of the differential logic circuit while substantially maintaining the output voltage swing of the differential logic circuit substantially constant, the control circuit comprising:

a first transistor connected to the current source so as to form a current mirror therewith;

a second transistor coupled to the load transistors so that the operating characteristics of the load transistors substantially match the operating characteristics of the second transistor; and a first device, coupled between the second transistor and the first transistor and having a current level that is selectively adjusted based upon a received input signal generated externally to the digital circuit, the current level of the first device setting the resistance value of the second transistor.

11. The digital circuit of claim 10, wherein:

the second transistor includes a first conduction terminal coupled to the first device of the control circuit, a second conduction terminal coupled to the second reference voltage source and a control terminal coupled to the control terminals of the load transistors; and the digital circuit further comprises a second device, coupled between the control terminal of the second transistor and the first conduction terminal thereof, for maintaining the second transistor in a linear mode of operation.

12. A digital circuit comprising:

at least one differential logic circuit, comprising:

a pair of input transistors, each input transistor having first and second conduction terminals and a control terminal, the first conduction terminals of the input transistors being connected together;

a current source coupled between the first conduction terminals of the input transistors and a first reference voltage source; and a pair of load transistors, each load transistor having a first conduction terminal coupled to the second terminal of an input transistor, a second conduction terminal coupled to a second reference voltage &source and a control terminal coupled to a control terminal of the other load transistor, the output of the differential logic circuit being the voltage difference across the first conduction terminals of the load transistors; and a control circuit for selectively controlling a level of current passing through the current source of the differential logic circuit while substantially maintaining the output voltage swing of the differential logic circuit substantially constant, the control circuit comprising:

a first transistor connected to the current source so as to form a current mirror therewith;

a second transistor coupled to the load transistors so that the operating characteristics of the load transistors substantially match the operating characteristics of the second transistor;

a first device, coupled between the second transistor and the first transistor and having a current level that is selectively adjusted, the current level of the first device setting the resistance value of the second transistor, the second transistor includes a first conduction terminal coupled to the first device of the control circuit, a second conduction terminal coupled to the second reference voltage source and a control terminal coupled to the control terminals of the load transistors; and a second device comprising an amplifier circuit having an input coupled to the first conduction terminal of the second transistor and an output coupled to the control terminal of the second transistor, the second device maintains the second transistor in a linear mode of operation.

13. The digital circuit of claim 12, wherein:

the amplifier circuit comprises a differential amplifier circuit having a second input coupled to a third reference voltage source.

14. The digital circuit of claim 13, wherein:

the third reference voltage source is at a voltage level that is between the voltage level of the first and second reference voltage sources.

15. The digital circuit of claim 10, wherein:

the load transistors and the second transistor comprise MOS transistors.

16. The digital circuit of claim 10, wherein:

the output voltage swing of the differential logic circuit is substantially independent of process parameters.

17. The digital circuit of claim 10, wherein:

the output voltage swing of the differential logic circuit is substantially temperature independent.

18. The digital circuit of claim 10, wherein the digital circuit comprises a plurality of differential logic circuits, each differential logic circuit being coupled to the control circuit.

19. The digital circuit of claim 10, further comprising:

a second device for maintaining the second transistor in a linear region of operation.

20. An integrated circuit, comprising:

one or more differential logic circuits, each differential logic circuit comprising:

at least one pair of input transistors for receiving a differential signal;

at least one pair of load transistors coupled to the at least one pair of input transistors; and at least one current source coupled to the at least one pair of input transistors; and a control circuit, coupled to the one or more differential logic circuits, for selecting a current level in the at least one current source of the one or more differential logic circuits from a plurality of current levels, and the resistance value of the load transistors of the one or more differential logic circuits from a plurality of resistance values so that the output voltage levels of the one or more differential logic circuits are substantially constant, comprising current source circuitry having a single externally selected current that sets the current level in the at least one current source of the one or more differential logic circuits and the resistance value of the load transistors of the one or more differential logic circuits.

21. The integrated circuit of claim 20, wherein the control circuit further comprises:

a first transistor coupled to the at least one current source of the one or more differential logic circuits so as to form a current mirror therewith; and a second transistor coupled to the load transistors of the one or more differential logic circuits so that the load transistors have operating characteristics that substantially match operating characteristics of the second transistor, the current source circuitry being disposed between the second transistor and the first transistor.

22. The integrated circuit of claim 21, wherein:

the current source circuitry receives at least one input signal and generates a current that passes through the second transistor, the current source circuitry and the first transistor having a current level that is based upon the at least one input signal.

23. The integrated circuit of claim 22, wherein:

the current source circuitry comprises a plurality of selectively activated current sources connected in parallel with each other, each selectively activated current source being connected to the at least one input signal.

24. The integrated circuit of claim 21, wherein:

the second transistor is configured in a linear mode of operation.

25. The integrated circuit of claim 24, wherein the control circuit further comprises:

a device for maintaining the second transistor in the linear mode of operation.

26. The integrated circuit of claim 25, wherein:

the second transistor has a first conduction terminal coupled to the current source circuitry and a control terminal coupled to the control terminals of the load transistors of the one or more differential logic circuits; and the device comprises a differential amplifier circuit having a first input coupled to the first conduction terminal of the second transistor and an output coupled to the control terminal of the second transistor.

27. The integrated circuit of claim 26, wherein:

the differential amplifier includes a second input coupled to a reference voltage level.

28. The integrated circuit of claim 2, wherein:

the second transistor and the load transistors comprise MOS transistors.

29. The integrated circuit of claim 20, wherein:

the resistance value of the load transistors are substantially independent of process and temperature variations.

30. A method of controlling a differential logic circuit having a pair of load transistors, said method comprising the steps of:

receiving at least one input signal;

generating a current level selected from a plurality of current levels based upon the at least one input signal;

mirroring the current level in the differential logic circuit; and controlling the resistance of load transistors in the differential logic circuit so that the output voltage swing is substantially constant.

31. The method of claim 30, wherein the plurality of current levels are discrete current levels.

32. The control circuit of claim 1, wherein the controllable current source comprises:

a plurality of current sources connected in parallel relative to each other between the first transistor and the second transistor, each one of the plurality of current sources being connected in series to a distinct transistor.

33. The control circuit of claim 32, wherein the control terminal of each distinct transistor being connected to a distinct input control signal.

34. The control circuit of claim 32, wherein each of the plurality of current sources selectively sourcing a distinct current level.

35. The control circuit of claim 2, wherein the load transistors have operating characteristics that substantially match operating characteristics of the second transistor.

36. The digital circuit of claim 10, wherein the first device comprises:

a plurality of current sources connected in parallel relative to each other between the first transistor and the second transistor, each one of the plurality of current sources being connected in series to a distinct transistor.

37. The digital circuit of claim 36, wherein the control terminal of each distinct transistor being connected to a distinct input control signal.

38. The digital circuit of claim 36, wherein each of the plurality of current sources selectively sourcing a distinct current level.

39. The digital circuit of claim 11, wherein the load transistors have operating characteristics that substantially match operating characteristics of the second transistor.

* * * * *

UNITED STATES PATENT AND TRADEMARK OFFICE

CERTIFICATE OF CORRECTION

PATENT NO. : 6,411,159 B1
DATED : June 25, 2002
INVENTOR(S) : Michael J. Callahan, Jr.

It is certified that error appears in the above-identified patent and that said Letters Patent is hereby corrected as shown below:

Column 8,
Line 28, replace “&source” with -- source --

Signed and Sealed this

Twenty-fifth Day of February, 2003

JAMES E. ROGAN
*Director of the United States Patent and Trademark Office*